US005584481A

United States Patent [19]

Caluori et al.

[11] Patent Number: 5,584,481

[45] Date of Patent: Dec. 17, 1996

[54] TRAINING ACCESSORIES FOR GOAL-MAKING GAMES

[75] Inventors: Michael J. Caluori, 3948 Trempealeau Trail, Verona, Wis. 53593; Bruce L. Winkler, Madison, Wis.

[73] Assignee: Michael J. Caluori, Verona, Wis.

[21] Appl. No.: 673,740

[22] Filed: Jun. 26, 1996

[51] Int. Cl.[6] ..... A63B 69/00

[52] U.S. Cl. ..... 273/57.2

[58] Field of Search ..... 273/57.2, 1.5 A

[56] References Cited

U.S. PATENT DOCUMENTS

| | | | |
|---|---|---|---|
| 3,050,305 | 8/1962 | Bachand et al. | 273/1.5 A |
| 3,840,228 | 10/1974 | Greaney | 273/1 B |
| 4,023,797 | 5/1977 | Sarrasin | 273/57.2 |
| 4,245,843 | 1/1981 | Griggs | 273/393 |
| 4,839,968 | 6/1989 | Logsdon | 33/286 |
| 5,120,055 | 6/1992 | McCarthy et al. | 273/57.2 |
| 5,160,138 | 11/1992 | Sanders | 273/57.2 X |
| 5,354,048 | 10/1994 | Winesberry, Jr. | 273/1.5 A |
| 5,465,958 | 11/1995 | Brun | 273/57.2 |

FOREIGN PATENT DOCUMENTS

1659076A1 6/1991 U.S.S.R. .

*Primary Examiner*—Paul E. Shapiro
*Attorney, Agent, or Firm*—Lathrop & Clark

[57] ABSTRACT

An easy to use, self-adjusting device for creating a visual representation of the region within which a hockey puck must travel to score a goal from any position in front of a goal has two retractable cords which are attached at one end to a hockey stick and at the other to retractable spring take-up reels. The reels are releasably attached to the goal by a hook and loop fastener. Each cord extends from the reel to an elastic bungee-cord-type band that extends to a releasable clip connected to a removable bracket on the hockey stick. The cords are extended and retracted from the reel with movement of the hockey stick away from the goal to visually define the region of puck travel, and to permit on-the-fly demonstration of possible puck trajectories to both an offensive player and a goaltender, aiding these students in developing their hockey playing skills.

19 Claims, 3 Drawing Sheets

TRAINING ACCESSORIES FOR GOAL-MAKING GAMES

FIELD OF THE INVENTION

The present invention relates to recreational and sporting equipment in general, and in particular to training accessories for goal-making games.

BACKGROUND OF THE INVENTION

Hockey is a fast moving sport requiring skill, agility, and strategy. While once confined to northern climates, improved refrigeration and air conditioning equipment have made hockey an activity which is enjoyed nationwide and the development of inline skates. The widespread popularity of hockey now draws from a wide pool of players of ever greater natural gifts. In order to stay competitive, aspiring players must not only play the game frequently, but must undergo ever more vigorous training. The players of a hockey team work together to score a goal by striking a hard round rubber puck with a hockey stick into the opponent's goal. The scoring of a goal is opposed by the other team's players on the ice, in particular the goaltender who tries to prevent the entrance of the puck into the delimited goal.

During the course of a game, the puck is maneuvered by a single offensive player or passed between offensive players from the same team in order to get in a position to shoot the puck towards the goal. At the same time, defensive players are trying to take the puck away from the offensive players or at least prevent the puck from traveling towards the goal. The defensive player does this either by maneuvering the puck with his stick or by physically removing the puck from the offensive player's possession by blocking him against the outer boards defining the playing area or by knocking him off his feet. The goaltender, who is positioned in front of the goal, works to prevent the puck from entering the goal by blocking it or catching it with a glove. The pace of the game is very fast and thus it is important that a player have the ability to move and react quickly, both in maneuvering the puck and when positioning himself to shoot the puck towards the goal.

It is an important skill, therefore, both for the goaltender in preventing a goal, and for the player in shooting a goal, to be able to quickly recognize all of the possible angles that a puck could travel to successfully score from any position in front of the goal. This skill allows a player to recognize where to aim and shoot the puck and allows the goaltender to recognize where to best position himself in front of the net to prevent the puck from getting into the goal. Ideally, players should have an immediate mental image of the possible paths a puck may take when hit by a player at any given position with respect to the goal. Some positions to the sides of the goal provide a much narrower apparent entrance to the goal, for example, while positions directly in front of the goal yield a large range of possible entry paths.

In order to teach this skill, hockey coaches have used one or more nylon ropes or similar cords which have been tied to the goal and are either held by a person in front of the goal or wrapped around a hockey stick that was held in front of the goal. Laid out on the ice the cords enclose a region designating possible puck trajectories from a particular shooting position. While helpful, this approach is somewhat static and requires many manual adjustments to be made to the rope to change its length in order to show the angles from positions at different distances from the goal. Such adjustments require either having to change the rope completely, retying the rope to the goal and the hockey stick, or a cumbersome coiling of the rope as the stick is moved. Unfortunately, training techniques which are time-consuming and burdensome to deploy will be employed less frequently than desired. Typically, little time is taken during practice sessions to teach young players to recognize these regions. Instead it is hoped that a player will merely acquire this skill after accumulating years of experience during actual game play.

What is needed is a device for teaching hockey positioning skills which is effective and easy to use.

SUMMARY OF THE INVENTION

The apparatus of the present invention is a self-adjusting, easy to use device for teaching a hockey player where to best position himself in order to defend against or score a goal. The device creates a visual representation of the region within which a hockey puck must travel to score from any position in front of the goal. Visually representing this region also allows a goaltender to see where to maneuver himself in front of the net in order to be in the best position to block or catch a puck shot at the goal from any position in front of the goal. The device is self-adjusting, enabling it to continuously represent the region from any position as a player moves in front of the goal. This allows the goaltender to learn how the region changes as the position of the opposing player changes and how to respond and adjust his defensive position, thereby simulating game experience. In addition, it illustrates the angles in which a puck needs to travel to score a goal for a player as he maneuvers in front of the goal, enabling him to learn to recognize when and where to best attempt a shot that will be successful in scoring a goal.

The apparatus of the present invention defines this region using two cords, each attached at one end to a retractable reel that is attached to the goal post, and at the other end to the blade of the hockey stick. Each cord is attached to the retractable reel at a spool recoiled by a retractable coil and concealed in a housing. The first reel is attached to the first goal post and the second reel is attached to the second goal post by a hook and loop fastener that enables the reels to be manually secured to and removed from the goal post.

The two cords extend from the reels to a bracket removably fixed to a hockey stick. Fastening clips on the cords are connected to a projecting post which extends from the bracket. The bracket is an inverted U-shaped element, which fits over a conventional hockey stick blade and which is held in place by adjustable set screws.

The apparatus is easily attached and removed from both the goal and the hockey stick so that it can be used during a typical hockey practice session on a day to day basis. A visual representation of the region within which a hockey puck must travel is defined by the two cords and the opening of the hockey goal. Since the cords are retractable this region can be easily illustrated from any position in front of the goal sequentially, without the need to re-attach different cords of various lengths. This versatility enables the device to serve as an effective teaching aid for coaches that teaches a player skills that have normally been acquired only in real game situations, thereby accelerating the player's development.

In one embodiment, the cord extends from each reel to one end of an elastic band, with the elastic band extending to the fastening clip. The elastic band helps to alleviate some of the force at the retracting coil in the reel when the hockey stick is quickly re-positioned to illustrate different positions in front of the goal.

It is an object of the present invention to provide a device for teaching a hockey player where to best position himself in order to defend or score a goal from any position in front of the goal.

It is another object of the present invention to provide a self-adjusting and easy to use device for teaching a hockey player where to best position himself in order to defend or score a goal.

It is a further object of the present invention to provide a hockey training accessory which is compatible with all standard hockey sticks and goals.

It is an additional object of the present invention to provide a hockey training accessory which is rapidly installed and removed to facilitate training use.

It is also an object of this invention to provide a hockey training device which, by repeated use, will contribute to the game-winning skills of a player.

Further objects, features and advantages of the invention will be apparent from the following detailed description when taken in conjunction with the accompanying drawings.

DESCRIPTION OF THE PREFERRED EMBODIMENT

Figure 1:
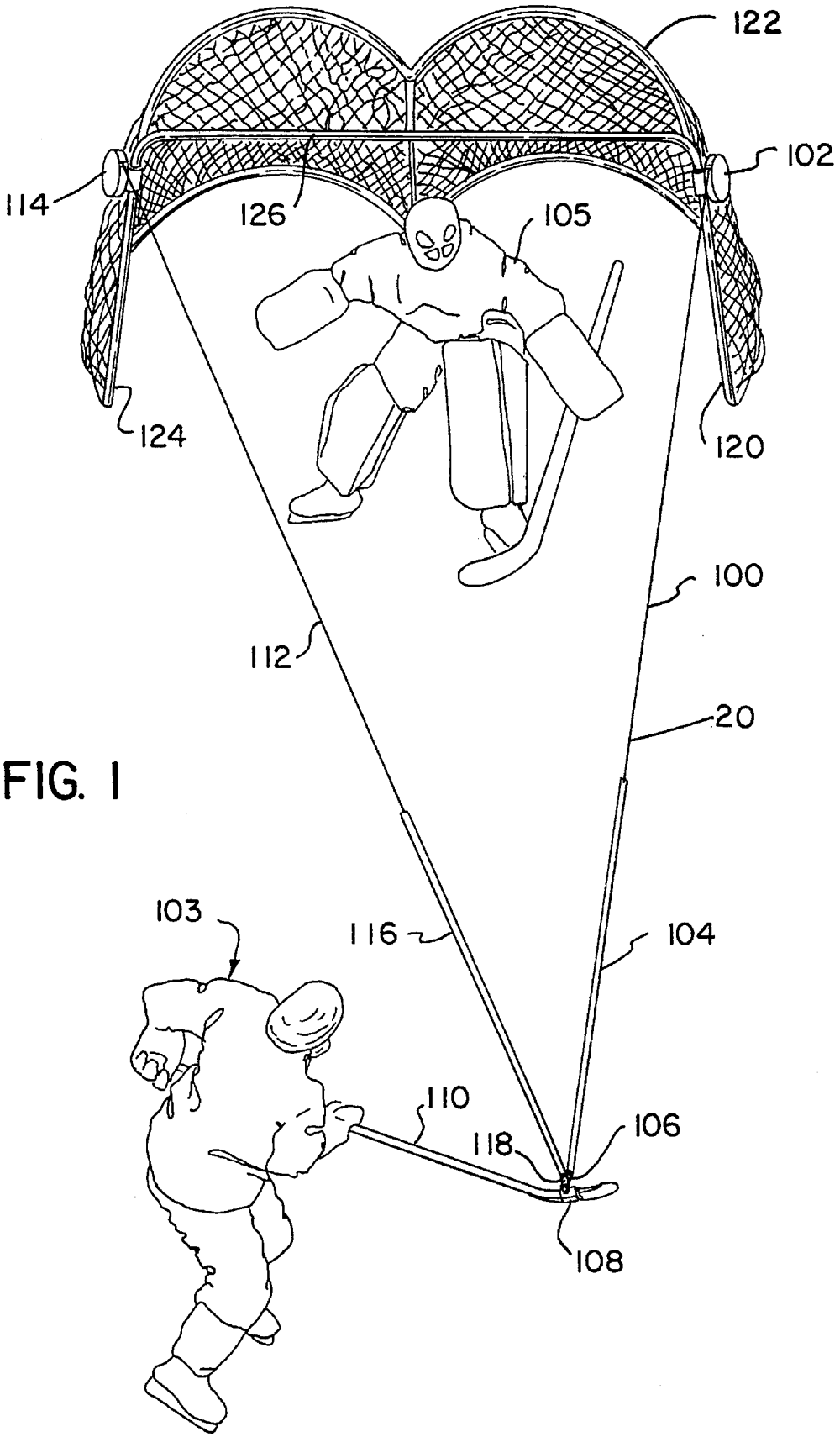
FIG. 1 is a top perspective view of a goaltender and offensive hockey player employing the instructional apparatus of the present invention in a training session.

Referring more particularly to FIGS. 1–4, wherein like numbers refer to similar parts, the hockey training apparatus 20 of the present invention is shown generally in FIG. 1. The apparatus consists of two portable reel assemblies 102, 114, which mount to the posts 120, 124 of the goal 122, and a removable bracket 108 which mounts to the blade of a hockey stick 110. These compact elements are rapidly deployable to serve as an instructional act to the training of hockey players. Cords are extendable from the reel assemblies 102, 114 to an offensive player's hockey stick 110 to define a region of potential goal-making puck trajectories.

As shown in FIG. 1, when an offensive player 103 is in position to make a goal attempt, he is positioned forwardly of a netted goal 122 having two upstanding goal posts 120, 124, joined by a crossbar 126 which define the player's target. The goal is defended by a goaltender 105 who may use his hockey stick to eject pucks which follow a trajectory along the ice, but who must use his gloves, his legs and his whole body to defend the goal from airborne pucks. Since a player may shoot the puck towards the goal 122 from any distance in front of or to the left or right of the goal, there are many different possible locations from which to shoot. Furthermore, because the goal extends horizontally and vertically, there are many successful trajectories a puck may take from any given position. For each offensive player position, there is a region that defines the possibly successful trajectories which a puck may travel for a shooter to score a goal.

During actual play, the goaltender 105 must on a moment's notice project himself to block a puck which may be launched from any of a wide range of positions. The successful goaltender will take account of the geometry of the hockey rink and goal 122, to anticipate launch trajectories and position himself in a blocking orientation. Such movements in a competitive game must take place at a near-instinctive level. The training apparatus 20 helps to rapidly inculcate an awareness of possible puck trajectories in a player, and thereby contribute to improved performance.

Although hockey training involves much team practice, when time permits the coach will provide one-on-one instruction to the players. When time becomes available for training of the goaltender 105 the apparatus 20 is readily installed by mounting the reel assemblies 102, 114 to the upright goal posts 120, 124 respectively.

Figure 2:
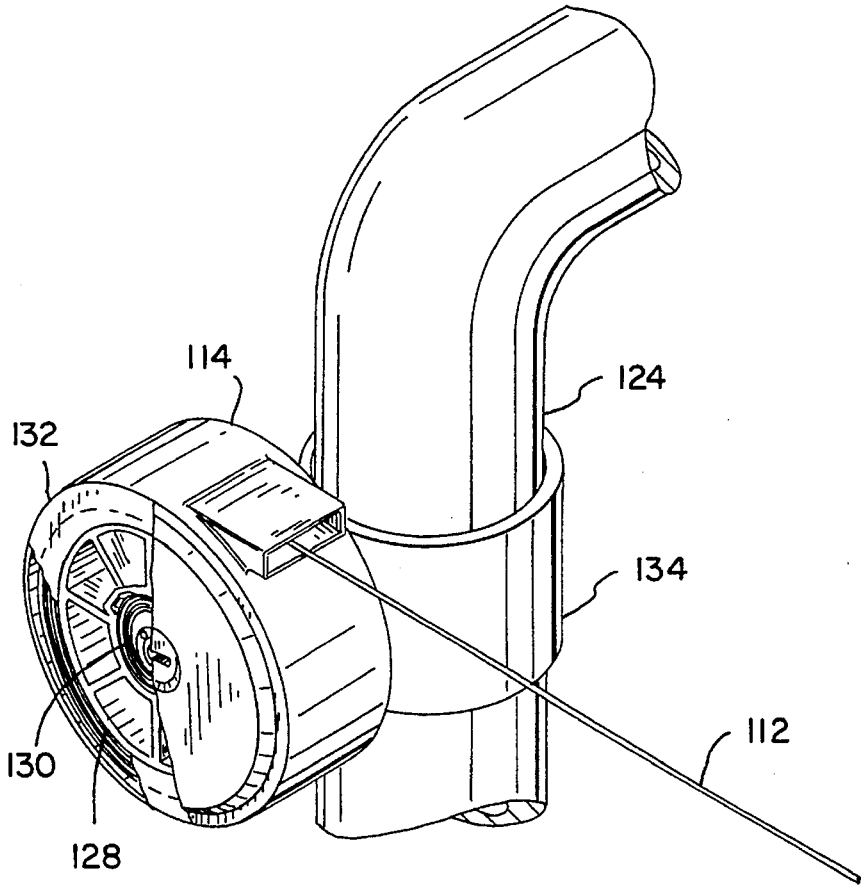
FIG. 2 is a fragmentary isometric view of the apparatus of FIG. 1 showing the retractable reel housing attached to a goal post with a cord extending therefrom.

As shown in FIG. 2, each reel assembly has a housing 132 within which is mounted a rotatable take-up spool 128 on which is wound a length of cord 112. The housing is preferably molded from plastic and has two segments which snap together to enclose the cord on its spool. A typical housing will be about 5½ inches in diameter. In a preferred embodiment the cords 100, 112 will each be approximately 50 feet long. A retracting constant force spring 130 extends between the takeup spool and a fixed portion of the housing 132. An exemplary spring is about 24 feet long. The typical constant force spring is a flat ribbon known as a spring motors·which exerts a constant force as it is uncoiled or retracted. As the cord 112 is pulled from the housing, the spring coil 130 is uncoiled. When tension on the end of the cord 112 is released, the spring 130 retracts the cord which is about 50 feet long within the housing 132.

The reel 102 may be connected to the goal post by a rigid bracket or other conventional fastening means. In a preferred embodiment, a strip of hook and loop fastener material 134, such as Velcro®, is connected to the housing 132 which permits the reel assembly 102 to be snugged up against the a goal post at any desired elevation. Other types of attachment mechanisms including a screw clamp, an over center cam lock, other types of cam mechanisms, and adhesive tapes, or the like could be used. The reels may be positioned anywhere from ice level to the crossbar, but are preferably positioned adjacent to the crossbar so that the extended cords define in the air around the goaltender the region to be defended. The strip of fastener material 134 holds the reel at a desired level, while at the same time permits pivoting of the housing to keep the cord extended evenly from the reel.

Figure 3:
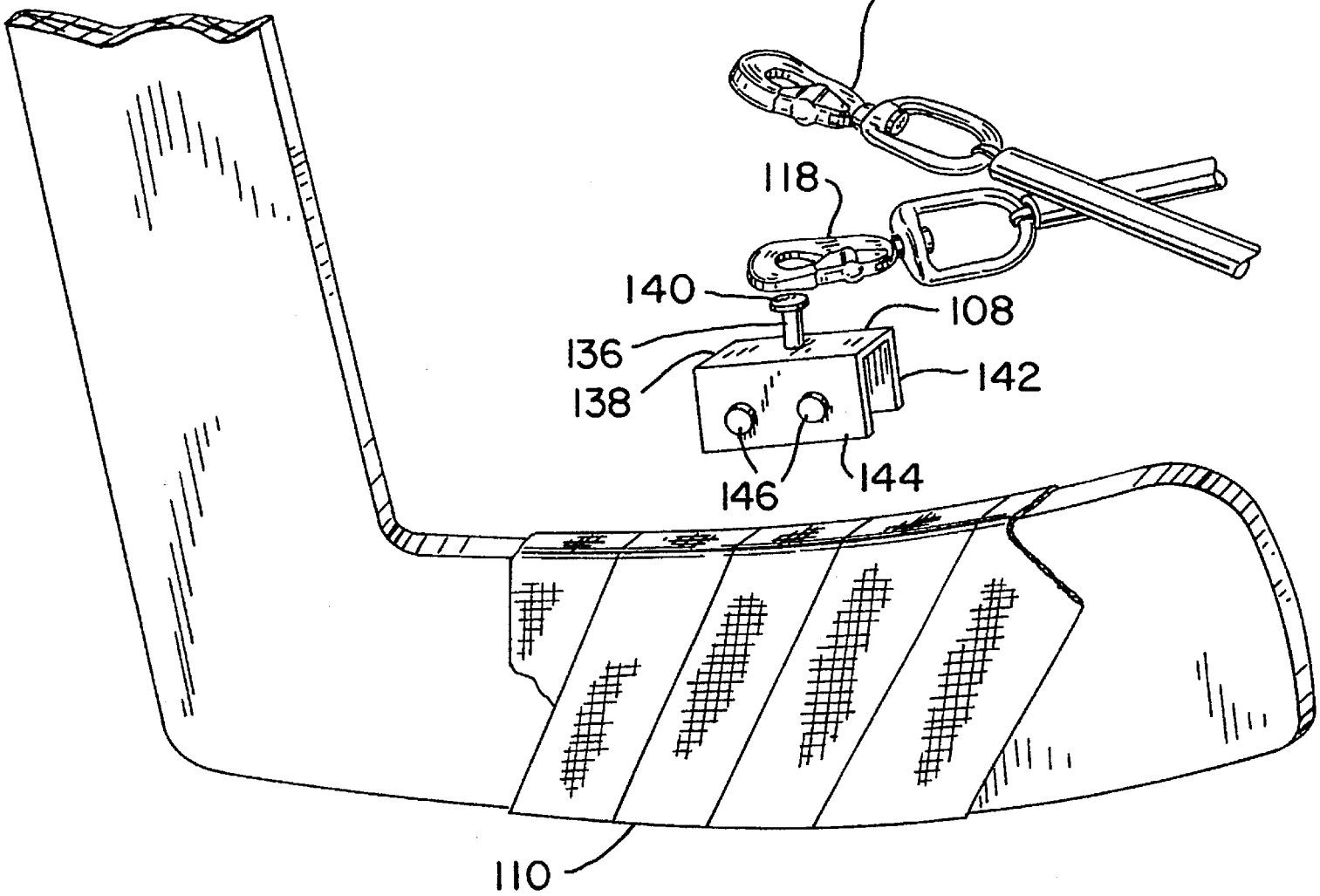
FIG. 3 is a fragmentary isometric view of the apparatus of FIG. 1 showing the fastening clips on the cord ends attached to a bracket on a hockey stick.

As shown in FIG. 3, a conventional hockey stick 110 is temporarily modified to receive the ends of the cords 100, 112, by attachment of the bracket 108 thus the hockey stick forms a means for positioning a goal scoring object. The bracket 108 may be formed of metal or plastic, and has a top wall 138 that extends between a front wall 142 and a back wall 144 which are generally parallel and spaced from each other a distance somewhat greater than the thickness of the hockey stick blade. In preparation for use of the training apparatus 20, the bracket 108 is slipped over the blade of the hockey stick 110, and knurl headed screws 146, or wingnuts, or the like fasteners which extend through the back wall 144 are rotated to fix the bracket 108 to the stick 110. A narrow projection or post 136 extends upwardly from the bracket top wall 138 and terminates in a flattened end cap 140.

Both the cords 100, 112 are generally non-resilient wound members, but, in order to provide some resilience to the connection between the stick 110 and the goal 122, a length of resilient cable, such as a bungee cord 104, 116 is connected to the end of each cord 100, 112 ahead of a terminating clip 106, 118. The clips 106, 118, may be conventional swivel-snap clips, as shown in FIG. 3, or any other appropriate releasable fastening means. The bungee cord segments 104, 116, are Two to four feet long and prevent the hockey player 103 from being caught up short when a cord 100, 112 is fully extended from its housing.

The two cords 100, 112 are attached to the hockey stick 110 by placing the fastening clips 106, 118 around the post 136. The fastening clips 106, 118 are prevented from sliding off the post 136 by the end cap 140 which has a diameter greater than the diameter of the post 136. The apparatus of the present invention can be easily attached to any hockey stick thereby allowing it to be used as a coaching tool during practice sessions. Such an ability to regularly illustrate and teach the appropriate positioning skills to players, even before they have had actual game experience, is an immeasurably useful tool for developing a hockey player's technique and teaching him skills that will make him a more successful player.

Figure 4:
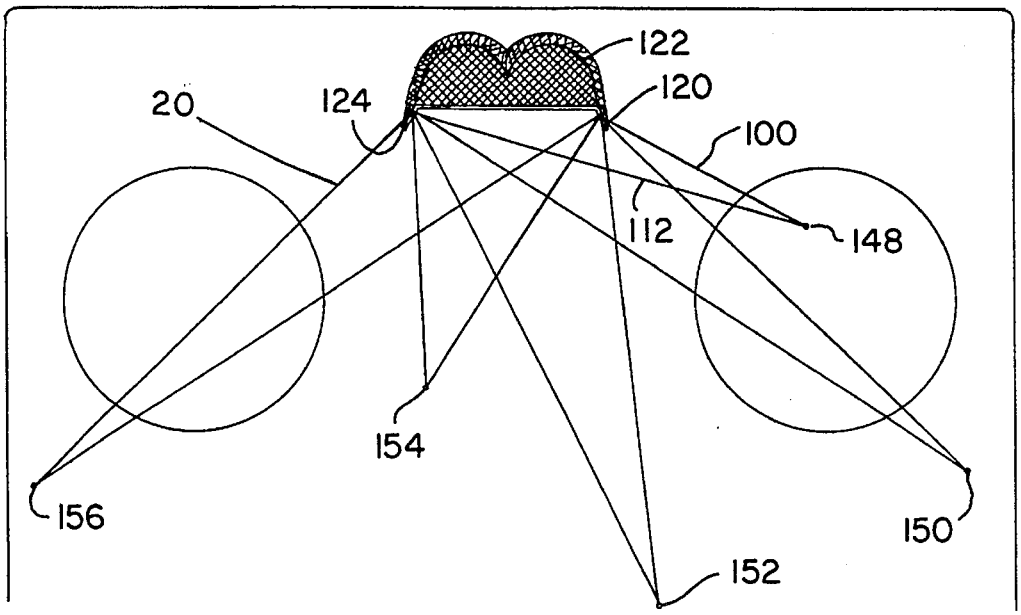
FIG. 4 is a schematic illustration of regions outlined by the cords of the present invention at various positions in front of the goal.

As shown in FIG. 4, the region within which the puck must travel to score a goal from any position in front of the goal 122 is visually represented between the cords 100, 112 extending from the goal 122 to the hockey stick 110. The offensive player or shooter 103 moves towards and away from the goal, and from left to right in front of the goal 122, simulating possible positions from which a shot may be attempted. As he moves, the two cords 100, 112, which are self-adjusting, extend from and retract into the reels 102, 114.

By illustrating the different regions as the player 103 moves in front of the goal 122, the player 103 can quickly identify the positions from which there exists a higher probability of success that a goal can be made, enabling him to choose his shots more effectively, and improving his prowess as an offensive player. The apparatus 20 will help the shooter 103 better understand the differences between his vision of the goaltender's position and the actual angle within which the puck must travel.

The apparatus 20, however, is most effective in training the goaltender. As the shooter 103 moves in front of the goal, the goaltender 105 can visually identify the region from which the puck will travel to score a goal, and with this information will be able to better position himself between the two goal posts 120, 124 to be most successful at blocking or catching the puck, thereby preventing a goal from being scored.

Not only do the cords 100, 112 provide a visual indicator of the region which the goaltender must protect, they can physically urge the goaltender into a preferred defensive position. For example, as shown in FIG. 4, if the offensive player 103 is positioned to shoot from a point 148 far to one side of the goal 122, the goaltender 105 has a visual representation of the sector of possible incoming puck shots defined by the two cords 100, 112. Moreover, at this position the offensive player's hockey stick 110 draws the second cord 112 across the front of the goal 122 thereby engaging against the goaltender 105 and forcing him to position himself closer to the first goal post 120. Should the offensive player 103 move outward away from the goal to the position 150 or 152, the cords 100, 112 open up, encouraging the goaltender 105 to move nearer the center of the opening, away from the first goal post 120. Movement of the offensive player 103 to a position 154 in front of the goal or to the opposite side of the goal 122 at a point 156 will likewise cause the cords 100, 112 to urge the goaltender 105 into a better defensive position.

Although the reels 102, 114 are illustrated in an elevated position, with the cord openings of the housings 132 elevated, if it is desired to position the cords very close to the surface of the ice, the reels may be inverted and mounted on opposite goal posts to bring the cords down lower and closer to ice level.

Other configurations of the training apparatus of this invention may also be employed. Instead of mounting the two reels separately on each goal post, a more compact unit having the two reels positioned one over the other may be mounted on the crossbar, with pulleys positioned at each end of the crossbar to direct the cords outwardly. Likewise, a single unit combining both reels may be mounted to the hockey stick bracket, with the ends of the cords being tied to the goal posts. Or, a single reel may be connected to one goal post, with the cord extending over a pulley mounted on the hockey stick and back to a tied connection to the opposite goal post. In yet another alternative, which would provide the maximum amount of spring—and hence the least tension on the cords—two reels may be mounted to the stick and the cords from the stick reels may each be connected to a retracting reel mounted on the goal posts.

Training apparatus similar to that shown in FIG. 1–4 may be used with other goal scoring games such as Lacrosse, field hockey, etc. When a training apparatus is employed in other goal scoring games, or even when used in the game of hockey, the cords used to define the possibly successful trajectories for a shooter to score a goal may be attached to a means for positioning a goal scoring object unique to a particular game. A tool not normally used as part of a game, for example a marking stick (or even the point at which the two cords 100, 112 join), can also be considered a means for positioning a goal scoring object such as a ball or puck.

It should also be understood that wherein two bungee cords 104, 116 are shown terminating at clip 106, 118, a single bungee cord may be connected between the cords 100, 112. This arrangement will facilitate the training apparatus 20 retracting out of the way of the goalie when not in use.

It should also be understood that hockey, in addition to being played on ice, can be played with inline skates or conventional roller skates.

It should also be noted that retractable reels with battery-powered motor rewind drives may be employed in place of the spring driven units shown. Alternatively, the constant force spring could be geared to a take up spool.

It is understood that the invention is not limited to the particular construction and arrangement of parts herein illustrated and described, but embraces such modified forms thereof as come within the scope of the following claims.

I claim:

1. An apparatus for creating a visual representation of the region within which a goal scoring object must travel in order for a goal to be scored by passing through a goal opening defined between a first goal post to a second goal; the apparatus comprising:

a) a first segment of cord which extends from the first goal post to a means for positioning a goal scoring object;

b) a second segment of cord which extends from the second goal post to the means for positioning a goal scoring object, wherein the first and second cord segments define the region within which the goal scoring object must travel from the means for positioning a goal scoring object to the goal opening to score a goal; and b) at least one retractable reel connected to the cord at a takeup spool in cooperation with a retracting coil, the takeup spool and retracting coil enclosed in a reel housing wherein the cord is extendable from the housing with movement of the means for positioning a goal scoring object away from the goal.

2. The apparatus of claim 1 wherein a first reel is connected to the first goal post and a second reel is connected to the second goal post, and wherein the first segment of cord extends retractably from the first reel to a bracket mounted to the means for positioning a goal scoring object, and wherein the second segment of cord extends retractably from the second reel to the bracket.

3. The apparatus of claim 2 wherein a releasable clip is connected to the first segment of cord and another releasable clip is connected to the second segment of cord, and wherein the clips are releaseably connected to the bracket.

4. The apparatus of claim 1 wherein the segments of cord extend from a bracket mounted to the means for positioning a goal scoring object, the bracket having an upwardly extending protrusion which engages the segments of cord.

5. The apparatus of claim 4 wherein the bracket is a generally inverted U-shaped element, and wherein adjustable screws extend from the bracket to engage a blade of a hockey stick and thereby fix the bracket to the hockey stick for engagement with the first cord segment and the second cord segment.

6. The apparatus of claim 1 wherein the first segment of cord and the second segment of cord each have a first portion which is generally non-resilient, and a second, shorter portion, which is resilient.

7. An apparatus for creating a visual representation of the region within which a hockey puck must travel in order for a goal to be scored by passing through a goal opening defined by a crossbar which extends from a first goal post to a second goal post; the apparatus comprising:

a) a first segment of cord which extends from the first goal post to a hockey stick;

b) a second segment of cord which extends from the second goal post to the hockey stick, wherein the first and second cord segments define the region within which the puck must travel from the hockey stick to the goal opening to score a goal; and b) at least one retractable reel connected to the cord at a takeup spool in cooperation with a retracting coil, the takeup spool and retracting coil enclosed in a reel housing wherein the cord is extendable from the housing with movement of the hockey stick away from the goal.

8. The apparatus of claim 7 wherein a first reel is connected to the first goal post and a second reel is connected to the second goal post, and wherein the first segment of cord extends retractably from the first reel to a bracket mounted to the hockey stick, and wherein the second segment of cord extends retractably from the second reel to the bracket.

9. The apparatus of claim 8 wherein a releasable clip is connected to the first segment of cord and another releasable clip is connected to the second segment of cord, and wherein the clips are releaseably connected to the bracket.

10. The apparatus of claim 7 wherein the segments of cord extend from a bracket mounted to the hockey stick, the bracket having an upwardly extending protrusion which engages the segments of cord.

11. The apparatus of claim 10 wherein the bracket is a generally inverted U-shaped element, and wherein adjustable screws extend from the bracket to engage the blade of a hockey stick and thereby fix the bracket to the hockey stick for engagement with the first cord segment and the second cord segment.

12. The apparatus of claim 7 wherein the first segment of cord and the second segment of cord each have a first portion which is generally non-resilient, and a second, shorter portion, which is resilient.

13. A hockey training apparatus for creating a visual representation of the region within which a hockey puck must travel in order for a goal to be gored by passing through a goal opening defined by a crossbar which extends from a first goal post to a second goal post; the apparatus comprising:

a) a connecting bracket having portions which releasably engage a hockey stick;

b) a first reel mounted to the first goal post;

c) a first cord wound on the first reel;

d) a first means for retracting the first cord onto the first reel;

e) a first connector extending from the first cord, the first connector releasably fastening the first cord to the bracket;

f) a second reel mounted to the second goal post;

g) a second cord wound on the second reel;

h) a second means for retracting the second cord onto the second reel;

i) a second connector extending from the second cord, the second connector releasably fastening the second cord to the bracket, wherein the first cord and the second cord are extendable from the first reel and the second reel, respectively, with movement of the hockey stick away from the goal, and are retracted by the means for retracting as the hockey stick is moved toward the goal, the first cord and the second cord thereby extending between the hockey stick and the goal to indicate a region of travel of a puck directed from the hockey stick to the goal, to thereby assist in training hockey players.

14. The apparatus of claim 13 wherein the first cord and the second cord each comprise a first substantially non-resilient portion, and a second resilient portion.

15. The apparatus of claim 13 wherein the first means for retracting comprises a coil spring connected between a fixed housing and the first reel.

16. The apparatus of claim 13 wherein the bracket comprises two side spaced wails connected by a top wail, the two wails fitting on opposite sides of a hockey stick blade, and further comprising at least one set screw extending through a side wail to fix the bracket to the hockey stick blade.

17. The apparatus of claim 13 wherein each reel is connected to a goal post by a hook and loop fastener which extends around the goal post and holds the reel at a selected elevation.

18. The apparatus of claim 13 wherein the first reel is contained within a rigid housing, said housing having an opening through which the cord extends, and wherein the opening is positioned above the centerline of the housing.

19. The apparatus of claim 13 wherein the bracket has a post which protrudes upwardly therefrom, and wherein the first connector and the second connector extend around the post.

* * * * *